US009302159B2

(12) United States Patent
Schwenger et al.

(10) Patent No.: US 9,302,159 B2
(45) Date of Patent: Apr. 5, 2016

(54) RACKET FOR BALL GAMES HAVING SOUND

(71) Applicant: Head Technology GmbH, Kennelbach (AT)

(72) Inventors: Ralf Schwenger, Weiler (DE); Stefan Mohr, Dornbirn (AT)

(73) Assignee: Head Technology GmbH, Kennelbach (AT)

( * ) Notice: Subject to any disclaimer, the term of this patent is extended or adjusted under 35 U.S.C. 154(b) by 26 days.

(21) Appl. No.: 14/328,082

(22) Filed: Jul. 10, 2014

(65) Prior Publication Data

US 2015/0018137 A1 Jan. 15, 2015

(30) Foreign Application Priority Data

Jul. 11, 2013 (EP) ..... 13176133

(51) Int. Cl.
*A63B 49/02* (2015.01)
*A63B 51/00* (2015.01)
*A63B 49/00* (2015.01)

(52) U.S. Cl.
CPC ..... *A63B 49/002* (2013.01); *A63B 49/022* (2015.10); *A63B 51/00* (2013.01); *A63B 49/028* (2015.10); *A63B 60/54* (2015.10); *A63B 2060/002* (2015.10)

(58) Field of Classification Search
CPC ..... A63B 49/02; A63B 49/002; A63B 51/00; A63B 49/028
USPC ..... 473/539–542
See application file for complete search history.

(56) References Cited

U.S. PATENT DOCUMENTS 1,132,214 A * 3/1915 Ries et al. ..... A63B 51/02 473/543
1,528,311 A * 3/1925 Surridge ..... A63B 49/002 473/542
1,611,232 A * 12/1926 Reach ..... A63B 49/002 473/539
1,627,621 A * 5/1927 Schindler ..... A63B 49/002 473/542
3,567,225 A * 3/1971 Hollis ..... A63B 49/002 273/DIG. 8
4,033,582 A * 7/1977 Linden ..... A63B 51/00 473/540
4,138,109 A * 2/1979 Nobbs ..... A63B 49/027 473/539
4,172,596 A * 10/1979 Linden ..... A63B 51/00 473/531
4,930,778 A * 6/1990 Mizuno ..... A63B 49/002 473/540
5,014,987 A * 5/1991 Soong ..... A63B 49/002 473/537
5,209,472 A * 5/1993 Tseng ..... A63B 49/002 473/537

(Continued)

FOREIGN PATENT DOCUMENTS

DE 20 2006 007 812 U1 9/2006
FR 2 340 747 9/1977

(Continued)

*Primary Examiner* — Raleigh W Chiu
(74) *Attorney, Agent, or Firm* — Bookoff McAndrews, PLLC

(57) ABSTRACT

The present invention relates to a racket for ball games comprising a frame forming a head portion and a handle portion, wherein the head portion accommodates a string bed comprising strings and defining a string plane, wherein the strings of the string bed are passed through several holes in the head portion, wherein at least three strings are passed through three of said holes in such a way that the longitudinal axis of each of said three holes extends in a first direction and the string passed through the hole extends within the string bed in a second direction, wherein the first and the second direction include an angle having an absolute value between 0.5° and 15° and wherein the absolute values of the angles of these three strings differ by maximally 3°.

21 Claims, 2 Drawing Sheets

(56) References Cited

U.S. PATENT DOCUMENTS 5,232,219 A * 8/1993 Tseng ..... A63B 49/14 473/539
RE34,420 E * 10/1993 Darling ..... A63B 49/007 473/522
5,251,895 A * 10/1993 Darling ..... A63B 49/002 473/520
5,263,709 A * 11/1993 Tseng ..... A63B 49/002 473/542
5,322,279 A * 6/1994 Davis ..... A63B 49/002 473/533
5,332,213 A * 7/1994 Klose ..... A63B 49/002 473/522
5,383,662 A * 1/1995 Gabrielidis ..... A63B 51/00 473/539
5,993,337 A * 11/1999 Janes ..... A63B 49/002 473/539
6,050,909 A * 4/2000 Severa ..... A63B 49/002 473/524
6,074,315 A 6/2000 Yimoyines
2006/0172828 A1 * 8/2006 Pezzato ..... A63B 49/002 473/527
2015/0018137 A1 * 1/2015 Schwenger ..... A63B 49/002 473/540

FOREIGN PATENT DOCUMENTS

GB 2 253 793 A 9/1992
WO WO 85/00114 1/1985
WO WO 98/28049 7/1998

* cited by examiner

RACKET FOR BALL GAMES HAVING SOUND

CROSS-REFERENCE TO RELATED APPLICATIONS

This application claims priority under 35 U.S.C. §119 to European Patent Application No. EP 13 17 6133.0, filed Jul. 11, 2013, the contents of which is incorporated herein by reference.

The present application relates to a racket for ball games having an improved sound.

Rackets for ball games typically generate a characteristic sound upon impact of a ball on the string bed of the racket for ball games. This sound is primarily influenced by the shape and material of the racket frame, the material of the strings forming the string bed, the tension of the strings, the stringing configuration and to a certain degree by the ball hitting the strings. Players typically perceive specific sounds as pleasant and other sounds rather as unpleasant. Markedly high frequencies upon hitting the ball, for example, are normally perceived as rather disturbing while a rich sound in a relatively low-pitched tone gives the feeling of a powerful stroke. The kind and duration of the reverberation of the sound can also cause positive or negative associations in the player's mind.

Since, however, the shape and the material of the racket frame, the material of the strings as well as the tension of the strings are normally optimized in view of a playability as good as possible, it is extremely difficult or impossible to improve the sound of the racket while maintaining this optimized play. It is therefore an object of the present invention to provide a racket for ball games having an improved sound profile. In particular, it is an object of the present invention to improve the sound of a racket for ball games without impairing the playing properties of the racket for ball games. This object is achieved by a racket for ball games according to claim 1.

The frame of the racket for ball games according to the invention forms a head portion for accommodating the string bed comprising one or more strings and a handle portion. The string bed defines a string plane. Normally, the entire string bed consists of one or two strings that form the string bed by repeatedly folding them over at the head portion. In the context of the present invention, however, the term "string" is meant to refer to a string portion extending from the outside of the frame through a hole, across the string bed, through a further hole up to the opposite outside of the frame. Depending on the alignment of such a string portion, it is referred to as "cross string" or "main string".

The strings of the string bed are passed through holes in the head portion of the racket frame wherein each string is passed through two opposite holes. The further presentation, however, will always relate to holes on one side. Hence, according to the invention, at least three strings are passed through three of said holes (on the same side of the racket head) such that the longitudinal axis of each of said three holes extends in a first direction and the string passed through the hole extends within the string bed in a second direction, wherein the first and the second direction include an angle $\alpha$ having an absolute value between 0.5° and 15° and wherein the absolute values of the angles $\alpha$ of these three strings differ by maximally 3°. The longitudinal axis of the hole denotes an axis perpendicular to the cross-section of the hole.

Preferably, the at least three strings are pressed thereby against the hole wall section confining the hole.

In other words, the strings passed through the holes experience a change in direction or a deflection or they have a bend there since the strings within the string bed, i.e. where they extend in a non-guided way, extend in a second direction whereas within the hole (or at least in a portion within the hole) they extend in a first direction along the longitudinal axis of the hole. The first and the second direction are preferably arranged with respect to each other in such a way that the strings are pressed against the hole wall section confining the hole. Preferably, the at least three strings thereby essentially permanently contact the respective hole wall sections confining the holes. Due to the fact that the strings are pressed against the hole wall sections confining the holes at a defined force while they are vibrating, the sliding frictional force of the strings on the respective hole wall section can be controlled such that the string vibration is damped relatively fast and a long reverberant sound is avoided.

What is relevant for this effect is less the angle between the first and the second direction but rather its absolute value, since an angle of, for example, +5° achieves the same effect as an angle of −5°. Furthermore, since usually at least three centrally arranged strings start strongly vibrating upon impact of a ball on the string bed and have a correspondingly large influence on the sound, it is intended according to the invention that at least three strings achieve an essentially analogous effect in that at least three strings experience a deflection to approximately the same extent. In other words, the absolute values of the angles in the case of the at least three strings should differ by maximally 3°. Preferably, at least four strings, more preferably at least five strings are passed correspondingly through the holes in order to achieve a larger effect or in order to achieve the effect even if the ball does not hit exactly the centre of the string bed.

The effect according to the invention is already achieved when the above discussed deflection of at least three strings is performed on one side of the racket head. Preferably, however, at least three strings on both ends, i.e. on opposite sides of the racket head, are passed through holes in such a way that the longitudinal axis of each hole extends in a first direction and the string passed through the hole extends within the string bed in a second direction, wherein the first and the second direction include an angle having an absolute value between 0.5° and 15° and wherein the absolute values of the angles of these three strings in all six holes differ by maximally 3°.

The absolute value of the angle between the first and the second direction is preferably between 1° and 10°, more preferably between 3° and 7° and particularly preferably about 5°. The absolute values of the angles of the at least three strings preferably differ by maximally 2°, preferably by maximally 1.5°. The force at which the strings are pressed to the hole wall portions confining the holes is preferably between 3.5 N and 150 N, more preferably between 7 N and 70 N, even more preferably between 20 N and 50 N and particularly preferably about 35 N.

The angle between the first and the second direction can generally be realized in different ways. The strings can extend within the string bed, for example, parallel to the racket axes (i.e. the main strings parallel to the longitudinal axis of the racket for ball games and the cross strings perpendicular to the longitudinal axis of the racket for ball games) and the longitudinal axes of the holes can be aligned at an angle relative thereto. It is also possible, for example, that the longitudinal axes of the holes extend along the racket axes (i.e. parallel or perpendicular to the longitudinal axis of the racket for ball games) and the strings within the string bed can be arranged at an angle relative thereto. It is likewise possible, for example, to combine both effects in order to achieve the desired angle between the first and the second direction. The extension of the longitudinal axis of the hole can be adjusted in different ways, such as, for example, by the configuration of bores in the racket head which are at an angle relative to the racket axes and into which substantially symmetrical grommets are inserted, or by bores extending substantially parallel to the racket axes and into which asymmetrical grommets are inserted so that the grommet hole axis forms an angle with respect to the bore axis. According to the invention, the term hole means the actual cavity through which the string passes. The alignment of said hole and thus of the extension of the string within it is determined as discussed above by means of the alignment of the bore, on the one hand, and the symmetry of the grommet (if any), on the other hand.

The present invention basically relates to both cross strings and main strings. According to the invention, the deflection can be provided at three or more cross strings and/or at three or more main strings. For the sake of clarity, the invention will be described in the following with respect to the cross strings. All features described as preferred are analogously applicable to the longitudinal strings.

According to a preferred embodiment of the racket for ball games according to the invention, the longitudinal axis of the racket defines a third direction, wherein the first and the third direction include an angle between 75° and 89.5°, preferably between 80° and 89°, more preferably between 83° and 87° and particularly preferably of about 85°. In this embodiment, the strings within the string bed (i.e. in the inner region of the head portion or within the string plane) preferably extend substantially perpendicular to the longitudinal axis of the racket. In other words, the racket for ball games of this preferred embodiment has cross strings that extend perpendicular to the longitudinal axis of the racket, are passed through one or more holes in the head portion and within said holes include an angle between 75° and 89.5° with the longitudinal axis of the racket. Alternatively to or in combination with these cross strings, the racket for ball games of this preferred embodiment can also comprise main strings whose extension through respective holes is at an angle or deflected. The person skilled in the art deduces from the above description that, in the case of main strings, the first and the second direction include an angle between 0.5 and 15°, preferably between 1° and 10°, more preferably between 3° and 7° and particularly preferably of about 5°.

In the case of cross strings, the holes through which the at least three strings are passed are preferably at about three o'clock and/or at about nine o'clock of the head portion of the racket frame (wherein the positions are meant to be defined in that the head portion opposite the handle portion is referred to as twelve o'clock and the head portion adjoining the handle portion as six o'clock). In the case of main strings, the holes are preferably at about six o'clock and/or at about twelve o'clock. Analogously to the above statements, all of the angle indications disclosed in the present application with respect to the cross strings can be transferred to respective angle indications for main strings. It is further preferred that both cross strings and main strings of the racket for ball games according to the present invention are passed through holes according to the invention. Preferably a plurality of cross strings, particularly preferably 5 to 10 cross strings, and/or a plurality of main strings, preferably 5 to 10 main strings, are pressed against the hole wall portions of respective holes.

Preferably the holes are formed by grommets which are fitted in the bores in the racket head. According to a preferred embodiment, the longitudinal axis of the racket defines a third direction and the longitudinal axis of the bore a fourth direction, wherein the grommet hole axis and the longitudinal axis of the bore extend substantially parallel and wherein the third and the fourth direction include an angle between 75° and 89.5°, preferably between 80° and 89°, more preferably between 83° and 87°, and particularly preferably of about 85°. In other words, the grommet is configured substantially symmetrical in this preferred embodiment so that the alignment of the hole is essentially defined by the alignment of the bore.

According to a further preferred embodiment, the grommet hole axis and the longitudinal axis of the bore include an angle between 0.5° and 15°, preferably between 1° and 10°, more preferably between 3° and 7° and particularly preferably of about 5°. In other words, the grommet is configured symmetrical in this preferred embodiment so that the alignment of the hole is essentially defined by the extension of the grommet hole within the grommet. In this preferred embodiment, the longitudinal axis of the racket and the longitudinal axis of the bore preferably include an angle of about 90° (in the case of main strings, the longitudinal axis of the racket and the longitudinal axis of the bore extend substantially parallel to each other). This embodiment has the advantage that it can be more easily manufactured since the provision of bores in the racket head having a defined alignment is technically more complicated than the provision of bores being aligned parallel or perpendicular to the longitudinal axis of the racket.

According to a further preferred embodiment of the racket for ball games according to the invention, holes which are opposite each other and directly connected with each other via a string have an offset in the longitudinal direction of the racket (i.e., in the transverse direction of the racket in the case of main strings). The offset is preferably between 1 mm and 25 mm, more preferably between 2 mm and 20 mm, even more preferably between 5 mm and 15 mm and particularly preferably about 10 mm. Due to the offset of opposite holes, the string between these opposite holes is aligned such that it extends with respect to the transverse axis or the longitudinal axis of the racket at an angle between 0.5° and 15°, preferably between 1° and 10°, more preferably between 3° and 7°, particularly preferably of about 5°. In this embodiment, the longitudinal axes of the holes preferably extend in the transverse or the longitudinal direction of the racket. The holes and the offset of opposite holes are preferably configured such that it is possible by means of different stringing configurations or stringing patterns to control which and/or how many of the cross and/or the main strings are pressed against a hole wall portion. Different sound profiles of the racket can thus be realized by means of different stringing patterns.

It is further preferred that the at least three holes have a cross-section whose extension substantially perpendicular to the string plane is larger than its extension substantially in the string plane. In other words, the string passed through such a hole is intended to have more moving space or freedom of motion in a direction extending substantially perpendicular to the string plane than in a direction extending substantially within the string plane.

It is further preferred that the cross-section of the at least three holes substantially perpendicular to the string plane is configured to be non-linear and/or that the longer cross-sectional axis and the string plane include an angle between 85° and 90°. A progressive or regressive sliding frictional force can be achieved by means of a non-linear hole cross-section since with increasing string deflection the normal force onto the string and thus the sliding frictional force grows. Thus, it is possible to achieve a damping coefficient that depends on deflection and/or depends on time.

Preferred embodiments of the present invention are described in the following with reference to the Figures, in which:

FIGS. 1*a, b* show a longitudinal section of a head portion and a top view onto the head portion of a racket for ball games according to a preferred embodiment comprising a hole according to the invention;

Figure 5:
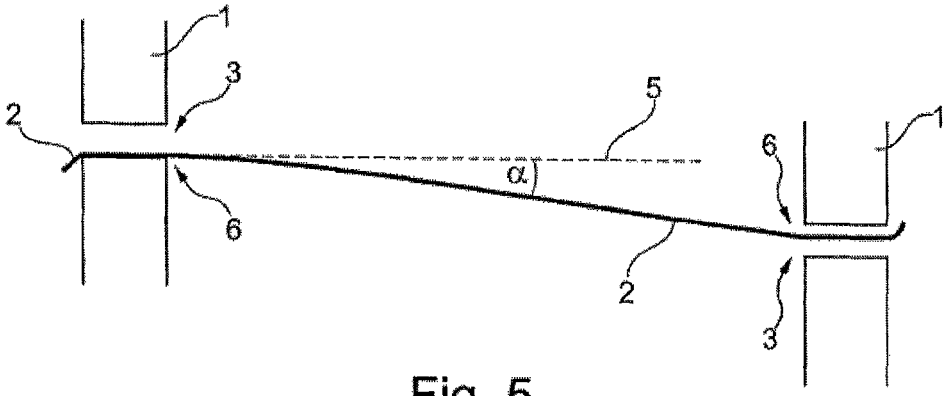
Figure 6A:
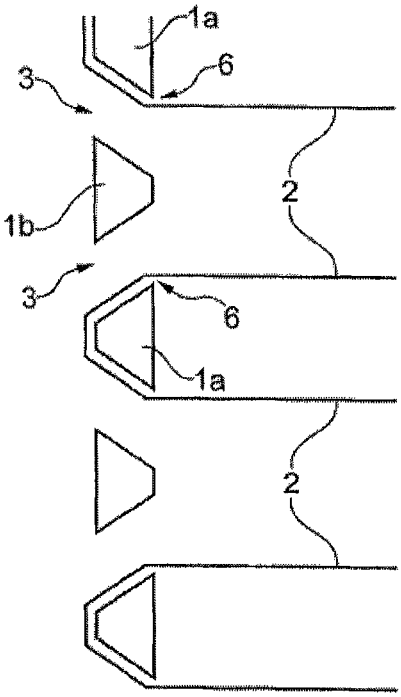

FIGS. 4*a-d* show top views onto the head portion of a racket for ball games according to different preferred embodiments comprising preferred holes;

FIG. 5 shows a longitudinal section of a head portion of a racket for ball games according to a further preferred embodiment comprising offset holes; and FIGS. 6*a, b* show longitudinal sections of head portion of a racket for ball games according to a further preferred embodiment comprising different stringing configurations.

Figure 1A:
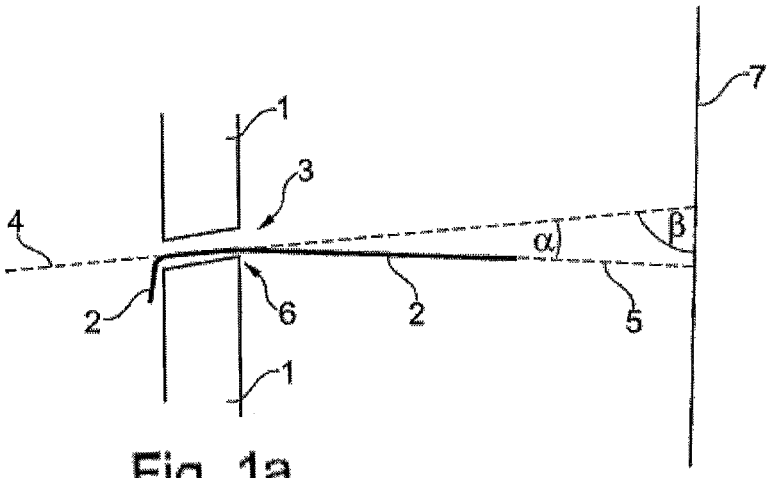

FIG. 1*a* shows a longitudinal section of a part of a head portion 1 of a racket for ball games according to a preferred embodiment. Such a racket for ball games, preferably a tennis or squash racket, typically comprises a head portion for accommodating a string bed and a handle portion. The string bed is typically formed of one or more strings and defines a string plane (in FIG. 1*a* the plane of projection). The strings of the string bed are normally passed through several holes in the head portion so that a specific stringing pattern is formed.

FIG. 1*a* depicts only a small section of a head portion 1 comprising one individual hole 3. The longitudinal axis of the racket, which extends from the handle portion to the head portion, is referred to with reference sign 7 in FIG. 1*a*. Furthermore, FIG. 1*a* illustrates a string portion 2 which is passed through the hole 3.

Figure 1B:
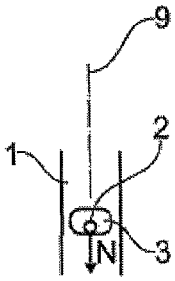

In the preferred embodiment, the hole 3 according to the invention, which is located in the head portion 1 of the racket for ball games, has a cross-section that is depicted in FIG. 1*b* in a top view and whose extension substantially perpendicular to the string plane 9 is larger than its extension substantially in the string plane 9. However, according to the invention, the cross-section of the hole 3 can also be symmetrical and in particular round. The string 2 is passed through the hole 3 such that the longitudinal axis 4 of the hole 3 extends in a first direction (cf. FIG. 1*a*) and the string 2 passed through the hole 3 extends within the string bed or the string plane in a second direction 5, wherein the first and the second direction include an angle $\alpha$ between 0.5° and 15° (or between −0.5° and −15°). Preferably, this entails that the string 2 is pressed against the hole wall portion 6 confining the hole 3 at the normal force N (cf. FIG. 1*b*).

According to the invention, at least three strings are passed in this way through respective holes. The absolute values of the angles $\alpha$ of these three strings are to deviate from each other by maximally 3°. In the illustrated embodiment this would mean, for example, that two further holes are provided substantially parallel to the depicted hole 3. Alternatively, a further hole could be configured substantially mirror-symmetrical (i.e. $\alpha 1=-\alpha 2$).

The expression "within the string bed" is to define that area of the strings which is confined by the head portion of the racket frame and extends within the racket head or string plane. In other words, the string 2 is to be deflected at the transition from the area within the string bed to the hole 3 such that the string 2 is pushed or pressed against the hole wall portion 6. Due to the fact that the string 2 is tensioned with the rope force, the deflected or angled portion of the string 2 automatically generates a normal force N pressing the string 2 into the direction of the hole wall portion 6.

Upon impact of a ball on the string bed of the racket for ball games, the string 2 depicted in FIG. 1*b* is deflected to the left or right substantially perpendicularly to the string plane 9. The string 2 thereby starts vibrating and rubs along the hole wall portion 6. The sliding frictional properties are defined by the coefficient of sliding friction $\mu$ between the string 2 and the hole wall portion 6. The normal force N causes a sliding frictional force $F_R=\mu\times N$. The vibration of the string can be damped by means of said sliding frictional force that is adjustable in a well-directed way and thus the sound generated upon impact of a ball can be manipulated in a well-directed way.

As explained above, the sliding frictional force depends, on the one hand, on the coefficient of sliding friction and, on the other hand, on the normal force. The normal force, in turn, is a function of the rope force in the string (i.e. the tension of the string bed), the angle $\alpha$ and the geometry of the hole wall portion 6. If the angle $\alpha$ is too small, the normal force is more or less negligible and no appreciable damping by sliding friction occurs. If, however, the angle $\alpha$ is too large, the normal force can become so large that static friction occurs, the string does not slide along the hole wall portion and thus likewise no damping occurs. It turned out that, when materials are used that are customarily used for the strings and the grommets, the angle $\alpha$ is preferably between 0.5° an 15°, more preferably between 1° and 10°, even more preferably between 3° and 7°, particularly preferably about 5°. The normal force at which the string is pressed against the hole wall portion confining the hole is preferably between 3.5 N and 150 N, more preferably between 7 N and 70 N, even more preferably between 20 N and 50 N and particularly preferably about 35 N.

Figure 4A:
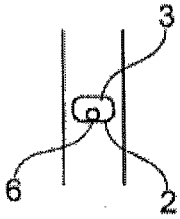
Figure 4B:
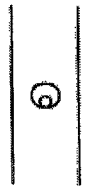
Figure 4C:
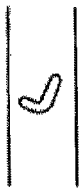
Figure 4D:
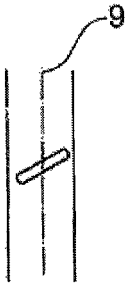

As explained above, the normal force can also be varied by the choice of the geometry of the contact surface or the contact area for the string 2 within the hole 3. When the hole wall portion 6 against which the string 2 is pressed is substantially planar as illustrated, for example, in FIG. 1*b*, the normal force in a first approximation is only a function of the angle $\alpha$ and, irrespective of the deflection of the string 2, substantially constant. However, when the hole wall portion 6 comprises an uneven surface or an inclination as illustrated in FIGS. 4*b-d*, the normal force is a function of the deflection of the string. In the embodiment of FIG. 4*d*, for example, the normal force in a first approximation is linearly dependent on the deflection of the string, whereas the normal force in the embodiment of FIGS. 4*b* and *c* is a non-linear function of the string deflection. In the case of FIG. 4*b*, this function is symmetrical, i.e. the normal force increases to the same degree upon deflections to the left and right from the rest position. The profile of FIG. 4*c* yields an asymmetric function in which a deflection of the string by a certain degree to the right entails a greater increase in the normal force than a deflection of the string by the same degree to the left. Finally, in the embodiment of FIG. 4*d*, a deflection of the string to the right causes an increase in the normal force and a deflection of the string to the left a decrease in the normal force.

It goes without saying that the cross-sections of the hole 3 depicted in FIG. 4 are only to be understood as examples to illustrate how the normal force acting onto the string 2 can be influenced by means of the geometry of the hole wall portion 6.

As explained above, the sliding frictional force additionally depends on the coefficient of sliding friction $\mu$. Said coefficient $\mu$ is essentially determined by the material of the string 2, the material of the hole wall portion 6 on which the string 2 rests, and the roughness. Since the material of the string as well as the material of the racket head 1 have to fulfil a plurality of requirements, it is particularly preferred to influence the coefficient of sliding friction μ in that only the hole wall portion 6 of the bore 3 is provided with a specific material and/or a specific roughness. The inner surface of the hole 3 can be coated, for example, with a specific material increasing the sliding friction. Appropriate materials are, for example, materials which are soft in comparison to the normal grommet strip material (PA6.6, PA11), such as conventional elastomers or thermoplastic elastomers, such as, e.g., Pebax, and also thermoplastic polyurethanes (TPUs). Alternatively or in combination therewith, the inner surface of the hole 3 can be roughened in a well-directed way in order to increase the sliding friction.

The holes of the present invention in the head portion of a racket for ball games can be realized, for example, in that respective bores are fitted in the racket head of a racket for ball games. Preferably, the racket head 1 comprises at least three bores as illustrated in FIG. 1 so that at least three cross strings are passed through such holes in such a way that they are pressed against the hole wall portions of the holes. One and the same string can be passed on one racket head side through a hole according to the invention and on the opposite racket head side through a conventional string hole. Particularly preferably, opposite string holes are each configured as in FIG. 1*a* in order to enhance the damping effect. Particularly preferably, these holes are approximately at three o'clock and/or nine o'clock. Preferably between 4 and 14 strings, more preferably between 5 and 12 strings and particularly preferably between 6 and 10 strings extend through such holes. Accordingly, the racket head preferably comprises 8 to 28 holes according to the invention, more preferably 10 to 24 preferred holes, and particularly preferably 12 to 20 preferred holes. Additionally or alternatively thereto, the racket for ball games according to the invention can comprise corresponding holes for the same number of main strings. These holes are preferably located approximately at six o'clock and/or approximately twelve o'clock.

Figure 2:
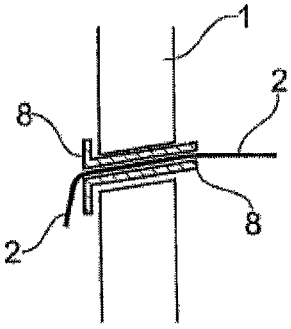
FIG. 2 shows a longitudinal section of a head portion of a racket for ball games according to a further preferred embodiment comprising a hole according to the invention.

According to a further preferred embodiment, which is illustrated in FIG. 2, the holes 3 are formed by grommets 8 fitted in or inserted into bores in the racket head 1. The grommets can be manufactured either in an accurately fitting way so that they fit exactly into the bevelled bores in the racket head or from a material flexible to such an extent that the grommets can adapt to bores having different bevels. The use of grommets permits to vary the coefficient of sliding friction μ in a particularly simple way in that a corresponding grommet material is used. Particularly preferred materials for such grommets are various polyamides (PA6.6, PA11, PA12) or also Pebax in various Shore hardnesses.

Figure 3:
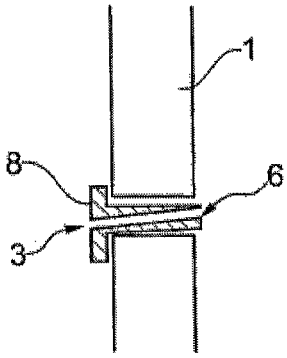
FIG. 3 shows a longitudinal section of a head portion of a racket for ball games according to a further preferred embodiment comprising a grommet according to the invention.

A further preferred embodiment is illustrated in FIG. 3. In this preferred embodiment, the hole 3 is also formed by a grommet hole of the grommet 8 inserted into a bore in the racket head 1. However, while the grommet hole axis and the longitudinal axis of the bore extend substantially parallel in the embodiment of FIG. 2, the grommet hole axis and the longitudinal axis of the bore include an angle in the embodiment of FIG. 3. This angle is preferably between 0.5° and 15°, more preferably between 1° and 10°, even more preferably between 3° and 7° and particularly preferably about 5°. This embodiment has the advantage that the racket head 1 can be provided with regular bores and the geometry of the hole 3 is only defined by the inserted grommet 8. On the one hand, the geometry of the hole 3 can be controlled in this way not only more easily but also more precisely. On the other hand, the sound profile of the racket for ball games according to the invention can thus be variably adapted to the personal preferences of a player in that correspondingly formed grommets are inserted into the present racket head bores. Hence, a commercially available racket can be retrofitted according to the invention with a respective set of grommets.

Accordingly, the present invention also relates to a grommet for a racket for ball games, wherein a longitudinal axis of the grommet is defined by the outer geometry of the grommet and wherein the grommet comprises a hole that defines a grommet hole axis. The longitudinal axis of the grommet and the grommet hole axis include an angle between 0.5° and 15°, preferably between 1° and 10°, more preferably between 3° and 7° and particularly preferably of about 5°. The grommet preferably consist of one of the following materials or a combination thereof: polyamide 6.6, polyamide 11, polyamide 12, Pebax. The present invention further relates to a set of several such grommets or a grommet strip comprising several such grommets.

In preferred embodiments, the grommet holes may comprise all of the features discussed above in general in connection with holes according to the invention either individually or in combination. In particular, the grommet holes may comprise the hole cross-sections discussed in connection with FIG. 4.

According to a further preferred embodiment of the present invention, opposite holes in the racket head which are directly connected by a string portion are offset with respect to each other in the longitudinal direction of the racket (this is applicable to cross strings, while in the case of main strings, the offset is perpendicular to the longitudinal direction of the racket). The offset is preferably between 1 mm and 25 mm, more preferably between 2 mm and 20 mm, even more preferably between 5 mm and 15 mm and particularly preferably about 10 mm. In the case of a corresponding stringing configuration, such an offset can have the effect that, for example, a cross string extends within the string bed in a direction that deviates from the perpendicular line to the longitudinal axis of the racket, as illustrated in FIG. 5. In this way, too, influence can be exerted on the force at which the string is pressed against the hole wall portion confining the hole. According to a preferred embodiment of the present invention (not illustrated), such an offset is applied in combination with bevelled holes. According to a further preferred embodiment of the present invention (cf. FIG. 5), the deflection of the string 2 at the transition between the inner area of the string bed, in which the string 2 freely extends, and the inner area of the hole 3, in which the string 3 is guided, is caused solely by the offset of opposite holes 3. In this embodiment, too, the longitudinal axis of the hole 5, which preferably extends perpendicular to the longitudinal axis of the racket, and the string 2 within the string bed include an angle α such that the string 2 is pressed against the hole wall portion 6 confining the hole 3. The angle α is preferably between 0.5° and 15°, more preferably between 1° and 10°, even more preferably between 3° and 7° and particularly preferably about 5°.

Figure 6B:
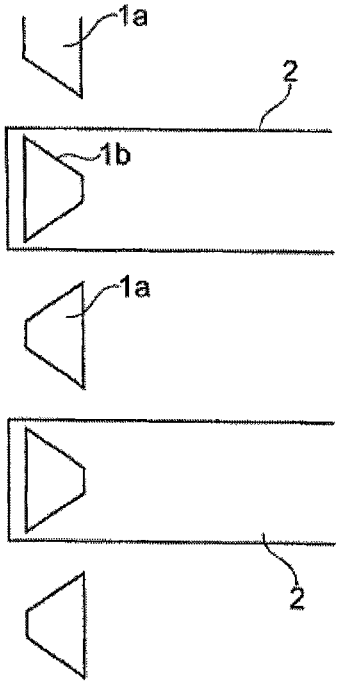

According to a further preferred embodiment of the present invention, the holes 3 in the racket 1 are configured such that the effect of the sound optimization according to the invention can be activated and deactivated. An example for a corresponding configuration and arrangement of the holes 3 is illustrated in FIGS. 6*a* and 6*b*. When the racket is strung as illustrated in FIG. 6*a*, the strings 2 pass around the portions la of the racket head and accordingly experience a deflection when entering the holes 3 so that the strings 2 are pressed against the hole wall portions 6 confining the holes 3. Accordingly, the above discussed damping effect will occur and the sound upon impact of a ball on the racket for ball games according to the invention is improved. However, when the racket is strung in the alternative pattern illustrated in FIG. 6*b*, the strings 3 pass around the portions 1*b* of the racket head and thus do not experience a deflection when entering the holes 3. In this case there is essentially no normal force so that no sliding fiction and thus also no damping effect occurs.

Against the background of the present invention, it should be clear to the person skilled in the art that the effect illustrated in FIGS. 6*a* and 6*b* can also be achieved with other means. The racket can be provided, for example, with bores in such a way that at least for some bores there is both a bore with offset and a bore without offset on the opposite side of the racket head so that depending on the stringing pattern use is made of the offset or the offset is dispensed with. The string 2 correspondingly extends either in a slightly inclined way as illustrated in FIG. 5 or exactly perpendicular to the longitudinal axis of the racket. In this way, too, the sound improvement according to the invention could be activated or deactivated by means of different stringing configurations.

The invention claimed is:

1. A racket for ball games comprising a frame forming a head portion and a handle portion, wherein the head portion accommodates a string bed comprising strings and defining a string plane, wherein the strings of the string bed are passed through several holes arranged in a common plane in the head portion, wherein at least three strings are passed through three of said holes in such a way that a longitudinal axis of each of said holes extends in a first direction and the string passed through the hole extends within the string bed in a second direction, wherein the first and the second direction include an angle having an absolute value between 0.5° and 15° and wherein the absolute values of the angles of these three strings differ by maximally 3°.

2. The racket for ball games according to claim 1, wherein at least four strings are passed through at least four of said holes in such a way that the longitudinal axis of each of said holes extends in the first direction and the string passed through the hole extends within the string bed in the second direction, wherein the first and the second direction include an angle having an absolute value between 0.5° and 15° and wherein the absolute values of the angles of these three strings differ by maximally 3°.

3. The racket for ball games according to claim 1, wherein the angle is between 1° and 10°.

4. The racket for ball games according to claim 1, wherein the absolute values of the angles of said strings differ by maximally 2°.

5. The racket for ball games according to claim 1, wherein the force at which the at least three strings are pressed against a hole wall portion confining a respective hole is between 3.5 N and 150N.

6. The racket for ball games according to claim 1, wherein a longitudinal axis of the racket defines a third direction and wherein the first and the third direction include an angle between 75° and 89.5°.

7. The racket for ball games according to claim 1, wherein the holes are formed by grommets fitted in bores in the head portion.

8. The racket for ball games according to claim 7, wherein a longitudinal axis of the racket defines a third direction, a longitudinal axis of at least one bore defines a fourth direction and a grommet hole of at least one grommet defines a grommet hole axis, wherein the grommet hole axis and the longitudinal axis of the bore extend substantially parallel, and the third and the fourth direction include an angle between 75° and 89.5°.

9. The racket for ball games according to claim 7, wherein a grommet hole of at least one grommet defines a grommet hole axis, said grommet hole axis and a longitudinal axis of at least one bore including an angle between 0.5° and 15°.

10. The racket for ball games according to claim 9, wherein a longitudinal axis the racket defines a third direction and the longitudinal axis of the at least one bore a fourth direction, and wherein the third and the fourth direction include an angle of about 90°.

11. The racket for ball games according to claim 1, wherein holes which are opposite each other and connected with each other via a string portion have an offset in a longitudinal direction of the racket.

12. The racket for ball games according to claim 11, wherein the offset is between 1 mm and 25 mm.

13. The racket for ball games according to claim 1, wherein the three holes are arranged at about three o'clock and/or at about nine o'clock.

14. The racket for ball games according to claim 1, wherein one or more of the several holes in the head portion has a cross-section whose extension substantially perpendicular to the string plane is larger than its extension substantially in the string plane.

15. The racket for ball games according to claim 1, wherein a cross-section of the holes substantially perpendicular to the string plane is configured to be non-linear and/or wherein a longer cross-sectional axis of said holes and the string plane include an angle between 85° and 90°.

16. The racket of claim 1, wherein the common plane and the string plane are the same plane.

17. A racket, comprising:

a frame forming a head portion and a handle portion, wherein the head portion accommodates a string bed comprising strings and defining a string plane, wherein five or more strings of the string bed pass through five or more holes in the head portion in such a way that a longitudinal axis of each of the five or more holes extends in a first direction and a given string passed through a given hole extends within the string bed in a second direction, wherein the first and the second directions include an angle having an absolute value between 0.5° and 15° and wherein the absolute values of the angles of the five or more strings differ by 3° or less, wherein holes which are opposite each other and connected with each other via a string portion have an offset in a longitudinal direction of the racket.

18. The racket of claim 17, wherein the angle is between 3° and 7°.

19. The racket of claim 17, wherein the absolute values of the angles of the strings differ by 1.5° or less.

20. A racket, comprising:

a frame forming a head portion and a handle portion, wherein the head portion accommodates a string bed comprising strings and defining a string plane, wherein three or more strings of the string bed pass through three or more holes in the head portion in such a way that a longitudinal axis of each of the three or more holes extends in a first direction and a given string passed through a given hole extends within the string bed in a second direction, wherein the first and the second directions include an angle having an absolute value between 0.5° and 15° , and wherein the absolute values of the angles of the three or more strings differ by 3° or less, and wherein the three or more holes are arranged at about three o'clock and/or at about nine o'clock, wherein a cross-section of the holes substantially perpendicular to the string plane is configured to be non-linear and/or wherein a longer cross-sectional axis of said holes and the string plane include an angle between 85° and 90°.

21. The racket of claim 20, wherein a force at which the three or more strings are pressed against a hole wall portion confining each hole is between 3.5 N and 150 N.

* * * * *